US012408740B2

(12) United States Patent
Browne

(10) Patent No.: US 12,408,740 B2
(45) Date of Patent: Sep. 9, 2025

(54) UMBRELLA WITH PIVOTING LOCKING DEVICE AND RELATED METHODS

(71) Applicant: ATLeisure, LLC, Atlanta, GA (US)

(72) Inventor: William Martin Browne, Atlanta, GA (US)

(73) Assignee: ATLEISURE, LLC, Atlanta, GA (US)

( * ) Notice: Subject to any disclaimer, the term of this patent is extended or adjusted under 35 U.S.C. 154(b) by 202 days.

(21) Appl. No.: 18/329,782

(22) Filed: Jun. 6, 2023

(65) Prior Publication Data

US 2024/0180305 A1 Jun. 6, 2024

Related U.S. Application Data

(60) Provisional application No. 63/385,883, filed on Dec. 2, 2022.

(51) Int. Cl.

| | |
|---|---|
| ***A45B 25/14*** | (2006.01) |
| ***A45B 23/00*** | (2006.01) |
| ***A45B 25/08*** | (2006.01) |

(52) U.S. Cl.

CPC ..... *A45B 25/14* (2013.01); *A45B 23/00* (2013.01); *A45B 25/08* (2013.01); *A45B 2023/0012* (2013.01); *A45B 2023/0018* (2013.01); *A45B 2023/0031* (2013.01); *A45B 2023/0037* (2013.01)

(58) Field of Classification Search

CPC ..... A45B 25/14; A45B 23/00; A45B 25/08; A45B 2023/0012; A45B 2023/0018; A45B 2023/0031; A45B 2023/0037; A45B 2023/005; A45B 2025/146; A45B 2200/10

USPC ..... 135/98, 20.1, 20.3, 21, 39

See application file for complete search history.

(56) References Cited

U.S. PATENT DOCUMENTS

| | | | | |
|---|---|---|---|---|
| 1,902,774 | A | 3/1933 | Hans | |
| 2,088,127 | A | 7/1937 | Hermann | |
| 3,411,519 | A | 11/1968 | Heinz | |
| 3,496,950 | A | 2/1970 | Heinz et al. | |
| 3,856,032 | A * | 12/1974 | Schafer | A45B 19/06 135/38 |
| 5,287,869 | A | 2/1994 | Wu | |
| 5,387,048 | A | 2/1995 | Kuo | |
| 5,937,882 | A | 8/1999 | Harbaugh | |
| 6,302,124 | B1 | 10/2001 | DeMarco | |
| 6,330,887 | B1 | 12/2001 | Chen | |

(Continued)

*Primary Examiner* — Robert Canfield

(74) *Attorney, Agent, or Firm* — Allen, Dyer, Doppelt + Gilchrist, PA

(57) ABSTRACT

An umbrella includes a vertical support having a track carried on an outer surface of the vertical support, the track extending longitudinally, and a canopy configured to switch between an open state and a closed state. The umbrella also includes a sliding collar coupled to the vertical support and configured to slidingly engage the vertical support to control an angle of the canopy with respect to the vertical support, a first arm coupled between the sliding collar and the canopy, and a second arm coupled between the vertical support and the first arm. The sliding collar has a housing defining a recess, an activation button slidingly received by the recess of the housing and switching between an extended state and a retracted state, and a locking device carried by the housing. The locking device is configured to pivot about the housing to selectively engage the track in the extended state.

20 Claims, 9 Drawing Sheets

(56) References Cited

U.S. PATENT DOCUMENTS

| | | | | |
|---|---|---|---|---|
| 6,371,686 | B1 | 4/2002 | Wu | |
| 6,418,949 | B1 | 7/2002 | Lin et al. | |
| 8,104,492 | B2 * | 1/2012 | Dan | A45B 25/14 135/21 |
| 8,113,223 | B2 | 2/2012 | Wang et al. | |
| 9,057,475 | B1 | 6/2015 | Macfarlane | |
| 9,220,325 | B2 * | 12/2015 | Ma | A45B 23/00 |
| 9,237,785 | B2 | 1/2016 | Ma | |
| 9,364,058 | B1 | 6/2016 | Hsieh | |
| 9,433,268 | B2 | 9/2016 | Ma | |
| 9,595,907 | B2 | 3/2017 | Marohl et al. | |
| 9,724,629 | B2 | 8/2017 | Lane | |
| 10,136,709 | B2 * | 11/2018 | Ma | A45B 23/00 |
| 10,932,536 | B2 * | 3/2021 | Kong | A45B 17/00 |
| 11,266,212 | B2 * | 3/2022 | Jin | A45B 17/00 |
| 11,412,821 | B2 | 8/2022 | Wang et al. | |
| 2004/0226591 | A1 | 11/2004 | You | |
| 2010/0101614 | A1 * | 4/2010 | Wang | A45B 19/04 135/20.1 |
| 2010/0212705 | A1 * | 8/2010 | Tung | A45B 23/00 135/20.1 |
| 2019/0216188 | A1 * | 7/2019 | Truong | A45B 25/10 |
| 2021/0015223 | A1 | 1/2021 | McWhorter | |
| 2021/0386166 | A1 * | 12/2021 | Luo | A45B 25/02 |
| 2025/0059792 | A1 * | 2/2025 | Thomas | A45B 23/00 |

* cited by examiner

UMBRELLA WITH PIVOTING LOCKING DEVICE AND RELATED METHODS

RELATED APPLICATION

This application is based upon prior filed Application No. 63/385,883 filed Dec. 2, 2022, the entire subject matter of which is incorporated herein by reference in its entirety.

TECHNICAL FIELD

The present disclosure relates to the field of outdoor accessories, and, more particularly, to an umbrella and related methods.

BACKGROUND

Large patio-style umbrellas are useful on patios, decks, pools, beaches, and in other outdoor settings for providing protection from the sun and allowing users a convenient way to enjoy shade while participating in outdoor activities. Typically, the umbrella comprises a mast extending from a base, and a canopy coupled to the mast opposite to the base. A drawback to this design is that the mast and base occupy some of the shaded area, thereby limiting the usable area.

In some approaches, as disclosed in, for example, U.S. Pat. No. 5,937,882 to Harbaugh, assigned to the present application's assignee, the umbrella uses an offset/cantilever arrangement. In this example, the main pole utilizes a cantilever arrangement to suspend the canopy to the side of the main pole so that the main pole does not occupy space in the shaded area beneath the canopy. For additional convenience, the angle of the canopy can be adjusted with respect to the main pole. A potential drawback to this design is the utilization of a crank mechanism both for raising and lowering the canopy and for adjusting the angle of the canopy. Typically, the crank mechanism is mounted to the main pole, and the rope moves along a complex path with many turning points. This arrangement may require more winding force, and the rope may bind and wear, adversely affecting the umbrella's operation.

In another approach disclosed in U.S. Pat. No. 8,104,492 to Dan, also assigned to the present application's assignee, the umbrella includes separate mechanisms for opening and closing the canopy and adjusting the angle of the canopy. Here, the sliding collar adjusts the angle of the canopy, and the winch on the sliding collar controls the opening and closing of the canopy.

SUMMARY

Generally, an umbrella comprises a vertical support having a track carried on an outer surface of the vertical support, the track extending longitudinally, and a canopy configured to switch between an open state and a closed state. The umbrella also includes a sliding collar coupled to the vertical support and configured to slidingly engage the vertical support to control an angle of the canopy with respect to the vertical support, a first arm coupled between the sliding collar and the canopy, and a second arm coupled between the vertical support and the first arm. The sliding collar comprises a housing defining a recess, an activation button slidingly received by the recess of the housing and switching between an extended state and a retracted state, and a locking device carried by the housing. The locking device is configured to pivot about the housing to selectively engage the track in the extended state.

In particular, the recess may comprise a peripheral ledge, and the locking device may comprise first and second elastic members coupled between the peripheral ledge and the activation button and configured to bias the activation button in the extended state. The locking device may comprise a locking arm pivotably coupled to the housing and having a first end coupled to the activation button, and a second end opposite to the first end. The activation button may define a longitudinal recess therein to receive the locking arm. The locking device may comprise a pivot arm coupled between the housing and the locking arm. The activation button may define a medial recess therein to receive the pivot arm.

The locking device may comprise a locking pin coupled to the second end of the locking arm and configured to engage the track. The locking device may comprise a third elastic member carried by the locking pin and configured to bias the locking pin to engage the track. Also, the umbrella may also include a winding device carried by the sliding collar and coupled to the canopy, and the winding device may be configured to switch the canopy between the open state and the closed state.

Another aspect is directed to a method for making an umbrella. The method comprises forming a vertical support having a track carried on an outer surface of the vertical support, the track extending longitudinally, and coupling a sliding collar to the vertical support and configured to slidingly engage the vertical support to control an angle of a canopy with respect to the vertical support. The canopy is configured to switch between an open state and a closed state. The method also comprises coupling a first arm between the sliding collar and the canopy, and coupling a second arm between the vertical support and the first arm. The sliding collar comprises a housing defining a recess, an activation button slidingly received by the recess of the housing and switching between an extended state and a retracted state, and a locking device carried by the housing. The locking device is configured to pivot about the housing to selectively engage the track in the extended state.

DETAILED DESCRIPTION

Figure 1:
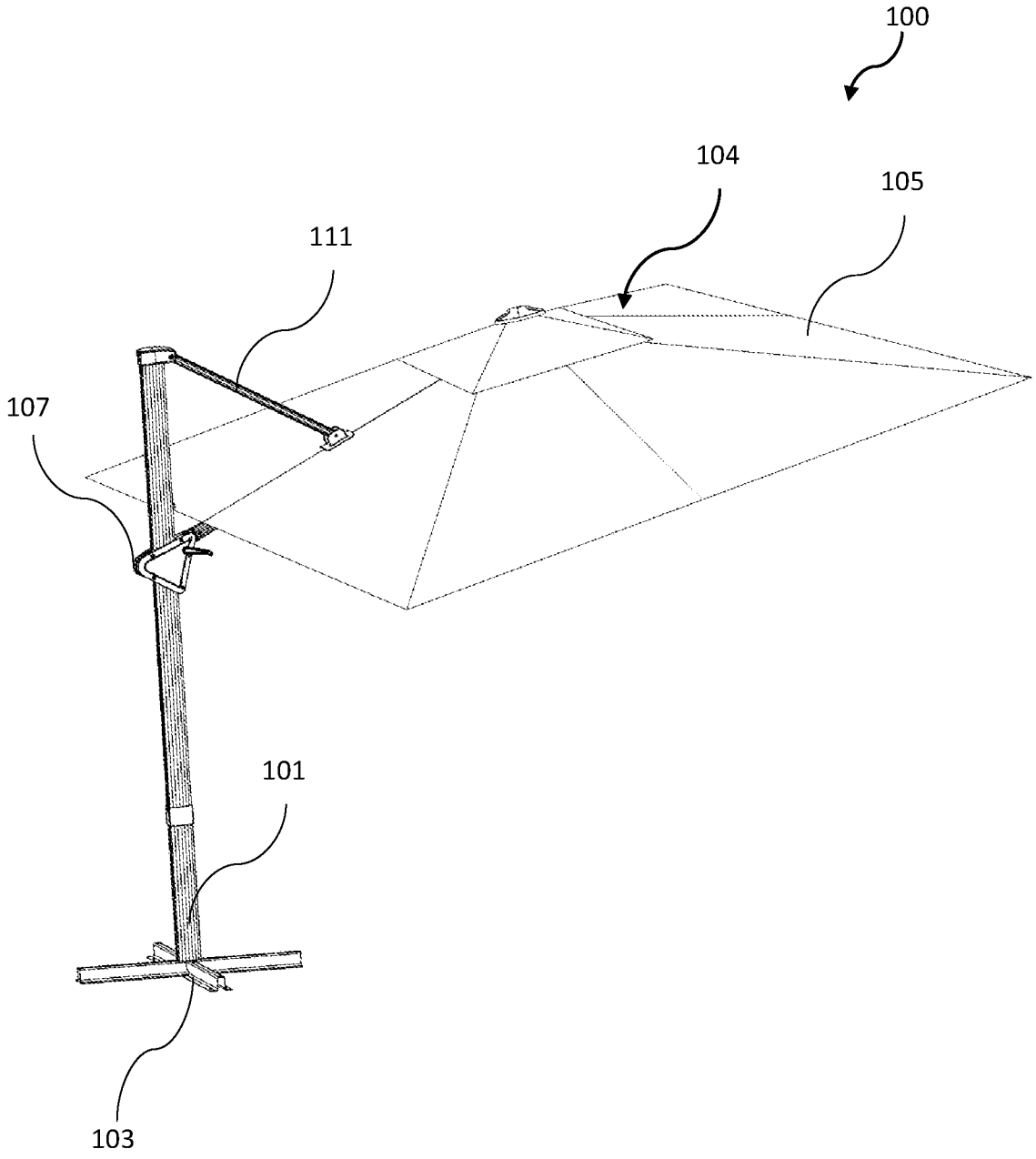
FIG. 1 is a perspective view of an umbrella in an open state, according to the present disclosure.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

Referring to FIGS. 1-9, an umbrella 100 according to the present disclosure is now described. The umbrella 100 may provide an approach to an issue with existing cantilever/offset umbrellas. In particular, the actuation of free movement of the sliding collar may be difficult for the user, making adjustment of the angle of the canopy difficult. In some approaches, the umbrella may use a compression mechanism to lock the sliding collar, but this may require greater than average hand strength, which may be less user friendly. Further, some users may not properly lock the sliding collar, permitting the canopy to unexpectedly move, for example, from a gust of wind.

The umbrella 100 comprises a vertical support 101 having a track 102 carried on an outer surface of the vertical support, and a base 103 coupled to a lowermost portion of the vertical support. Also, the vertical support 101 may comprise a metallic material, such as aluminum, but may comprise one or more metals in some embodiments. Indeed, any rigid material with sufficient mechanical strength may be used, for example, plastic, alternatively or in combination with the metallic material.

The track 102 extends longitudinally along the vertical support 101 and may extend over some or all of the vertical support. As perhaps best seen in FIGS. 8-9, the track 102 illustratively comprises interweaved teeth and recesses. In some embodiments, the track 102 may be integral with the vertical support 101, and in other embodiments, the track may be modular and installed onto the vertical support.

Figure 2:
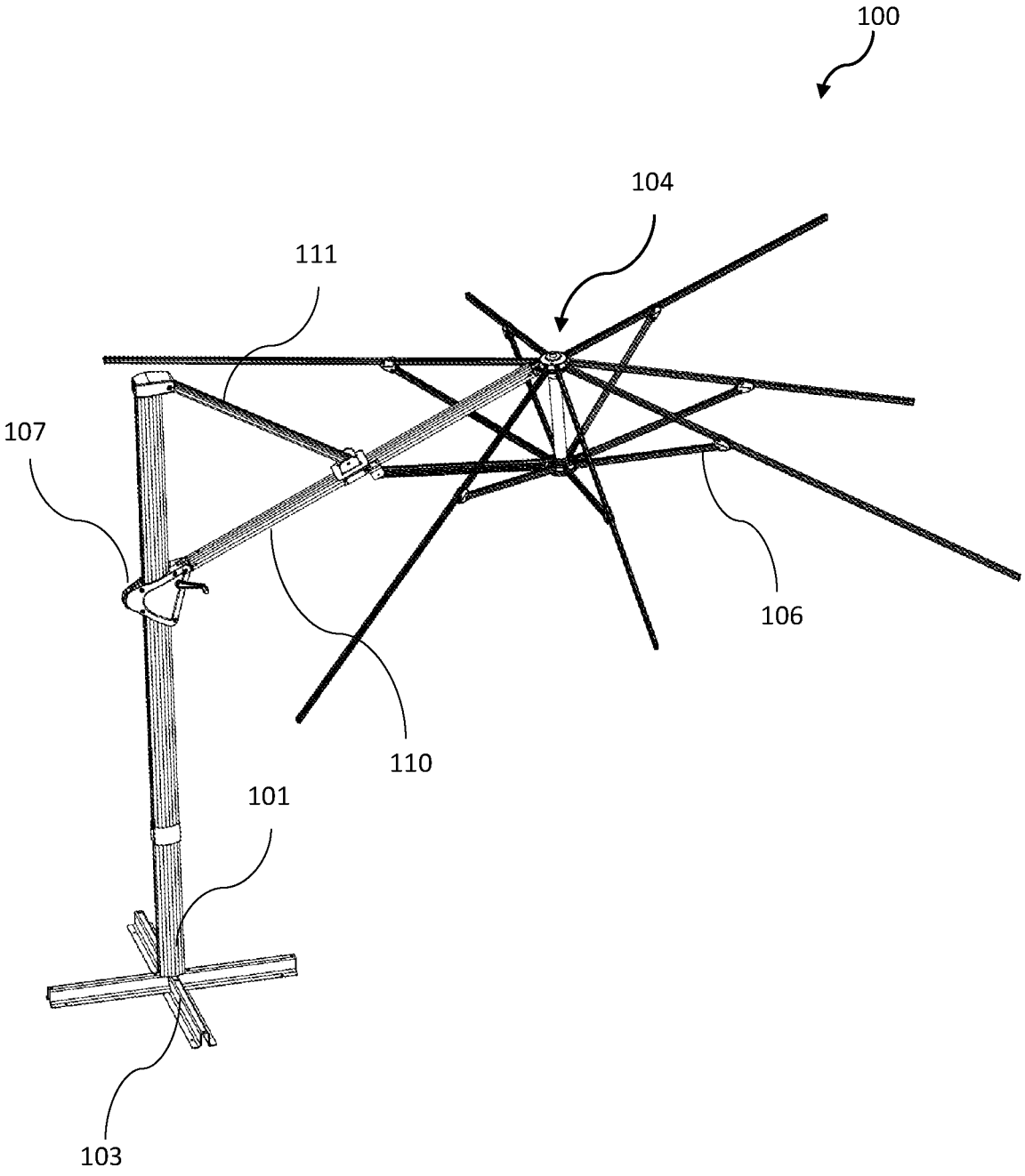
FIG. 2 is a perspective view of the umbrella from FIG. 1 without the canopy.
Figure 3:
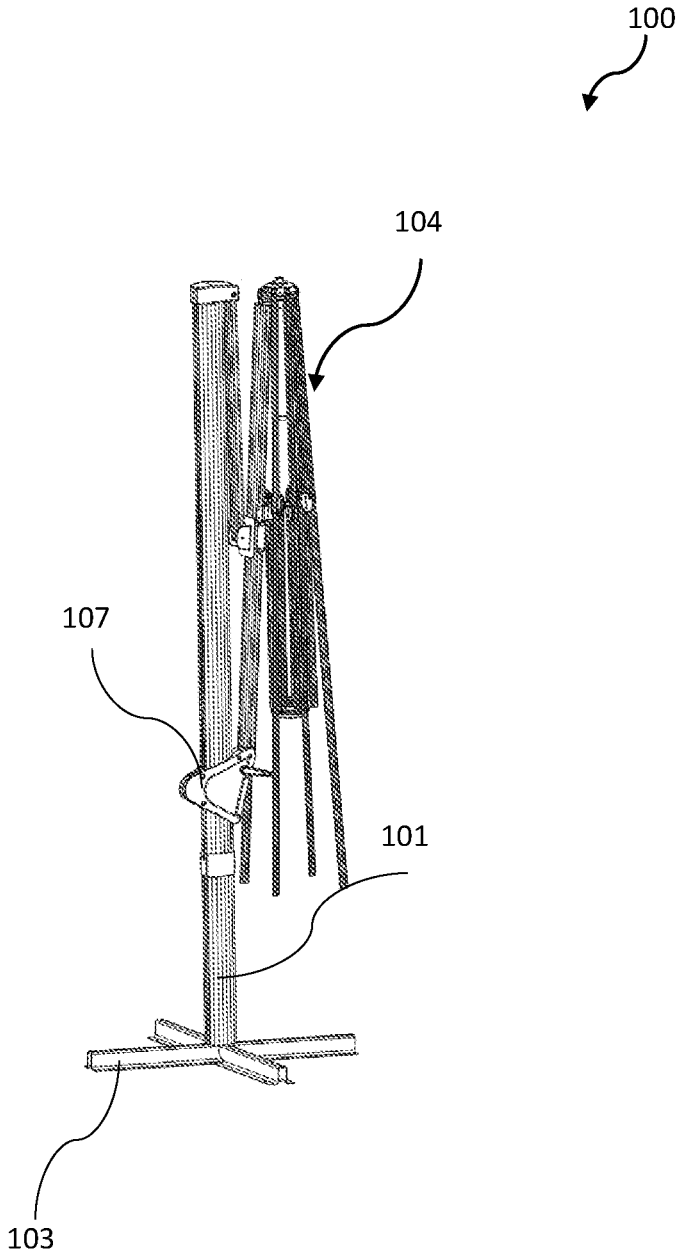
FIG. 3 is a perspective view of the umbrella from FIG. 1 in a closed state without the canopy.

The umbrella 100 comprises a canopy 104 configured to switch between an open state (FIG. 1) and a closed state (FIG. 3). The canopy 104 includes a fabric shell 105, and a structure 106 supporting the fabric shell. As will be appreciated, the structure 106 comprises a plurality of support arms, and a collar coupled to the plurality of support arms. The umbrella 100 also includes a sliding collar 107 coupled to the vertical support 101 and configured to slidingly engage the vertical support to control an angle of the canopy 104 with respect to the vertical support. As shown in FIG. 3, adjusting the sliding collar 107 downward stows the canopy 104 by decreasing the angle with the vertical support 101. As shown in FIGS. 1-2, adjusting the sliding collar 107 upward extends the canopy 104 outward by increasing the angle with the vertical support 101.

The umbrella 100 also includes a first arm 110 pivotingly coupled between the sliding collar 107 and the canopy 104. The umbrella 100 includes a second arm 111 pivotingly coupled between an uppermost portion of the vertical support 101 and the first arm 110.

The sliding collar 107 illustratively comprises first and second housing segments 112*a*-112*b*, and a plurality of fasteners 113*a*-113*f* coupling together the first and second housing segments. Each of the plurality of fasteners 113*a*-113*f* illustratively comprises a threaded machined screw, and an opposing threaded nut. Of course, other forms of fastening can be used, such as an adhesive bonding. The first and second housing segments 112*a*-112*b* cooperate to define a recess 114.

Figure 8:
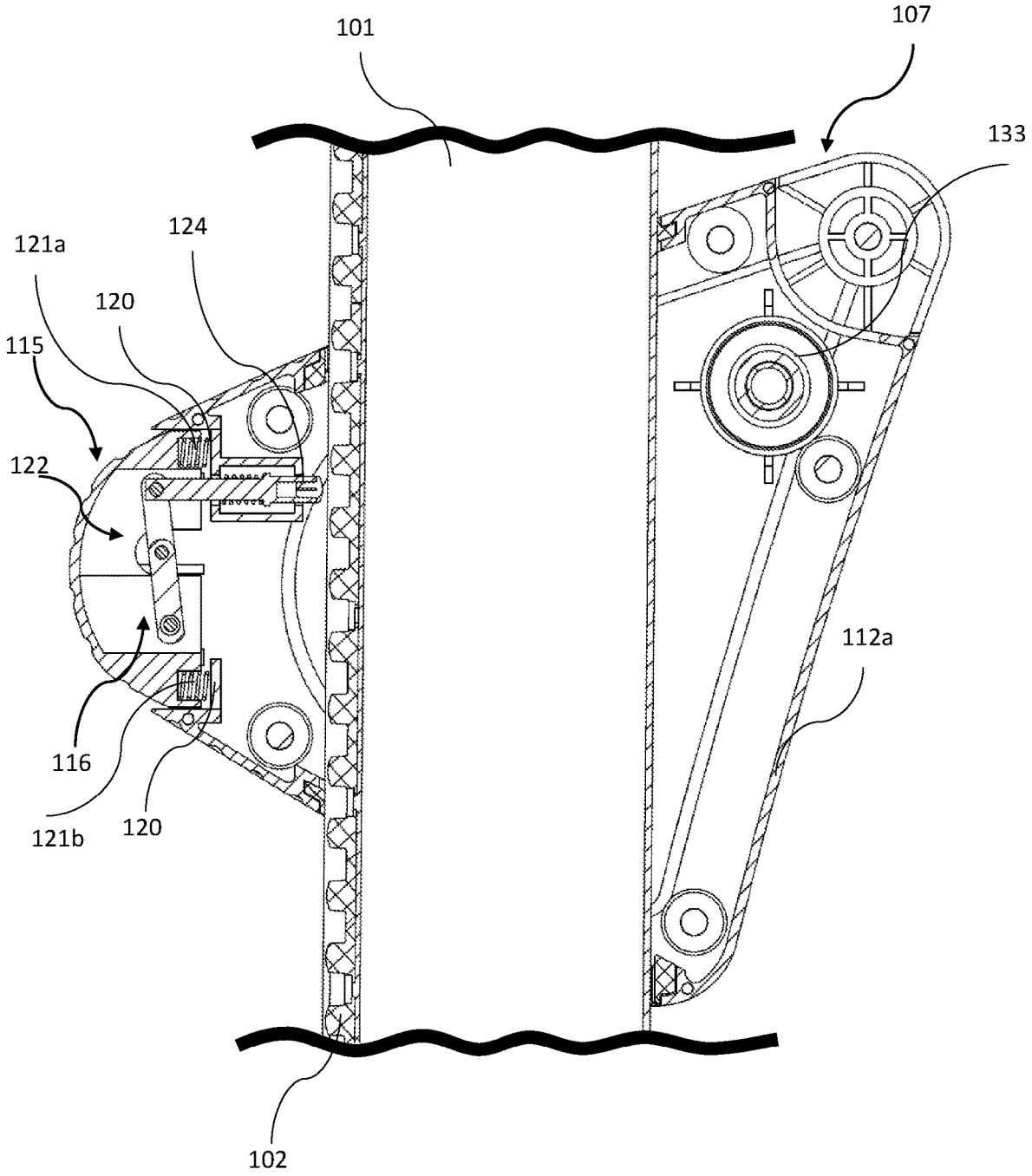
FIG. 8 is a cross-sectional view of the sliding collar along line 8-8 from FIG. 5 with the locking arm not engaging the track and with the activation button in a retracted state.

The sliding collar 107 comprises an activation button 115 slidingly received by the recess 114 of the first and second housing segments 112*a*-112*b* and switching between an extended state (FIG. 9) and a retracted state (FIG. 8). The sliding collar 107 comprises a locking device 116 carried by the first and second housing segments 112*a*-112*b*.

Figure 7:
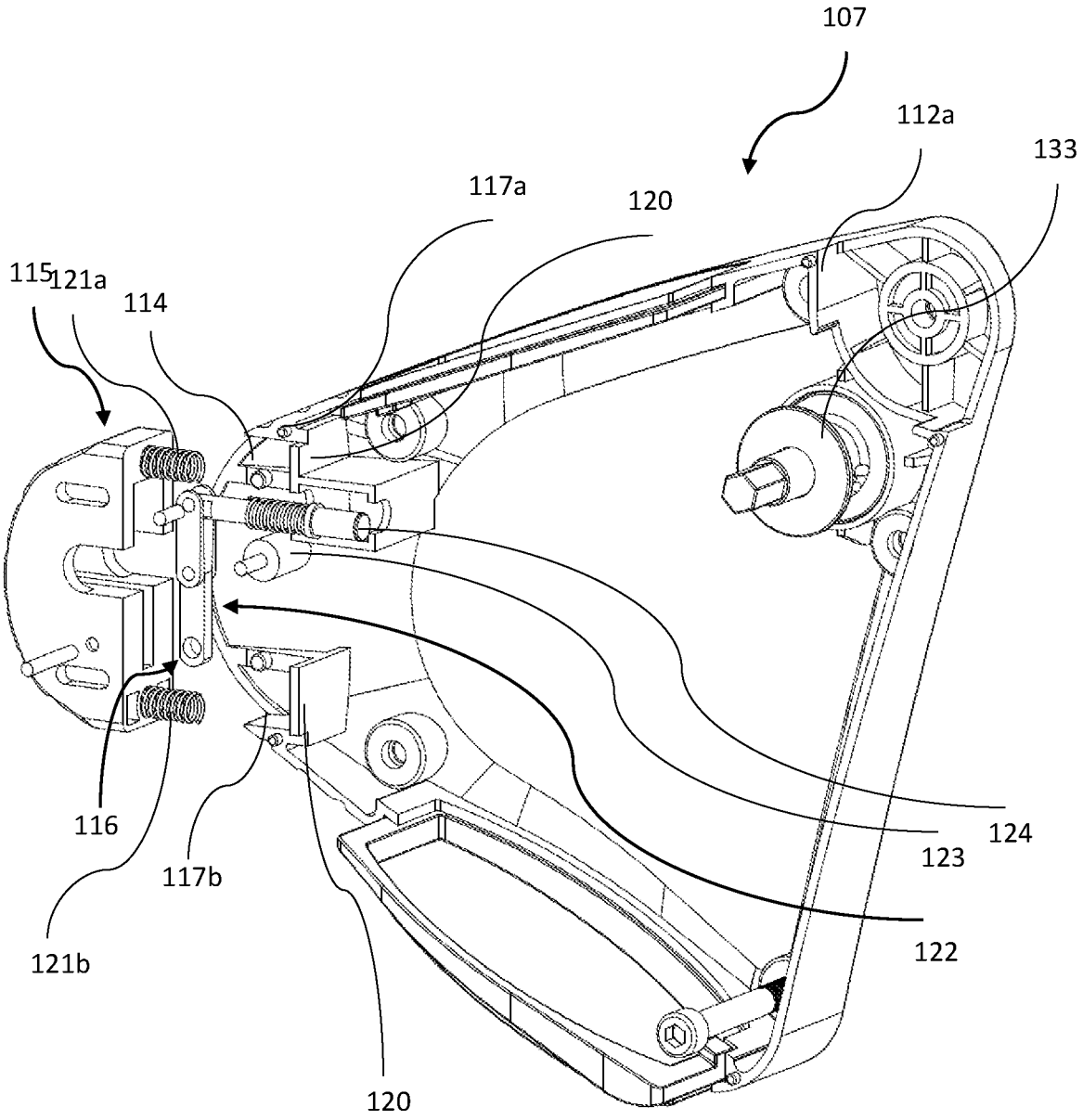
FIG. 7 is a perspective view of the sliding collar from the umbrella from FIG. 1 with some of the collar housing removed.

As perhaps best seen in FIG. 7, the recess 114 illustratively comprises first and second inner walls 117*a*-117*b* extending inwardly from an outer surface of the first housing segment 112*a*, and a peripheral ledge 120 extending from an innermost end of the first and second inner walls. The locking device 116 illustratively comprises first and second elastic members 121*a*-121*b* coupled between the peripheral ledge 120 and the activation button 115 and configured to bias the activation button in the extended state. In the illustrated example, each of the first and second elastic members 121*a*-121*b* comprises a coil spring.

The locking device 116 illustratively includes a locking arm 122 pivotably coupled to the first housing segment 112*a* and having a first end coupled to the activation button 115, and a second end opposite to the first end. In the illustrated embodiment, the first end of the locking arm 122 defines a passageway 128*a* to be aligned with another passageway 128*b* on the activation button 115, both of which receiving a fastener, such as an elongate pin. The locking device 116 comprises a pivot arm 123 (FIG. 7) coupled between the first housing segment 112*a* and a medial portion of the locking arm 122.

The locking device 116 comprises a locking pin 124 coupled to the second end of the locking arm 122 and configured to engage the track 102. The locking device 116 comprises a third elastic member 125, for example, the illustrated coil spring, (FIG. 6) carried by the locking pin 124 and configured to bias the locking pin to engage the track 102. In particular, the locking pin 124 illustratively comprises a flanged rim 129 to retain the third elastic member 125 against adjacent portions of the first housing segment 112*a* (i.e., portions opposite the peripheral ledge 120 best seen in FIGS. 8-9).

Figure 6:
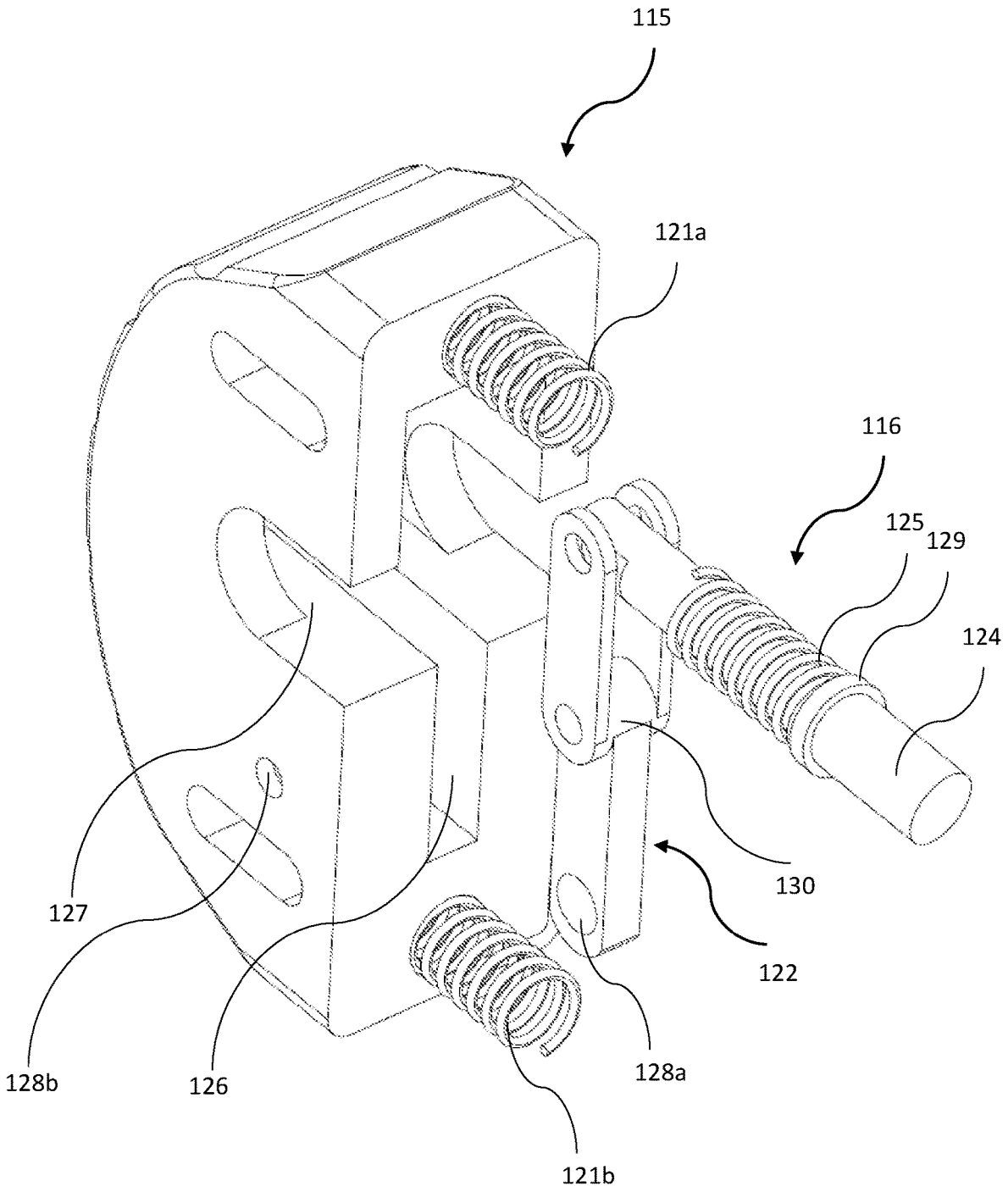
FIG. 6 is a perspective view of the activation button and the locking device from the umbrella from FIG. 1.

As perhaps best seen in FIG. 6, the activation button 115 defines a longitudinal recess 126 therein to receive the locking arm 122. The activation button 115 also defines a medial recess 127 therein to receive the pivot arm 123. In this illustrated example, the locking arm 122 comprises first and second arm segments coupled to the locking pin 124, a third arm segment, and an arm junction 130 coupling the first and second arm segment with the third arm segment. The arm junction 130 also receives the pivot arm 123.

Figure 9:
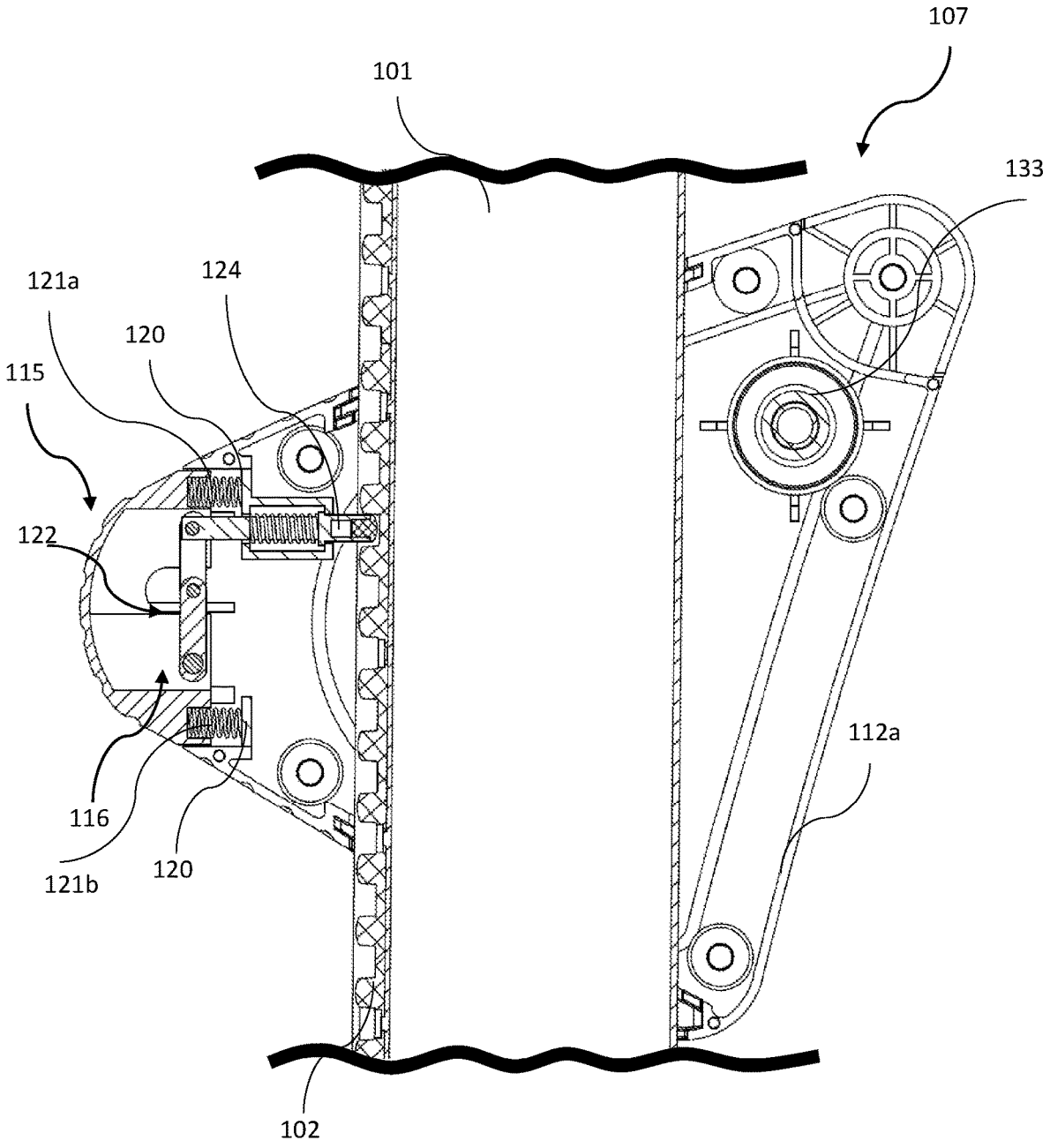
FIG. 9 is a cross-sectional view of the sliding collar along line 8-8 from FIG. 5 with the locking arm engaging the track and with the activation button in an extended state.

As will be appreciated and perhaps best seen in FIG. 8, the first end of the locking arm 122 is coupled to the activation button 115, and when the activation button is depressed into the retracted state, the first end of the locking arm 122 is pivoted downward, causing the second end of the locking arm and the locking pin 124 to travel upward and away from the track 102. In this retracted state, the first, second, and third elastic members 121*a*-121*b*, 125 are in a compressed state. As seen in FIG. 9, when the activation button 115 is released, due to the outward biasing of the first and second elastic members 121*a*-121*b*, the activation button returns to the extended state, which causes the first end of the locking arm 122 to pivot upward, causing the second end of the locking arm and the locking pin 124 to travel downward to the track 102 (aided by the downward biasing of the third elastic member 125). In other words, via these components, the locking device 116 is configured to pivot about the first housing segment 112*a* to selectively engage the track 102 in the extended state.

Advantageously, this makes adjustment of the sliding collar 107 easier than with existing approaches. Indeed, to adjust the angle of the canopy 104, the user need only depress the activation button 115 and gently slide the sliding collar 107. When the sliding collar 107 has reached the desired position (i.e., the canopy 104 has the desired angle with respect to the vertical support 101), the user releases the activation button 115, which springs into the extended position, locking the sliding collar 107 into place. In contrast to existing approaches, the sliding collar 107 is reliably locked into place without significant user effort.

Figure 4:
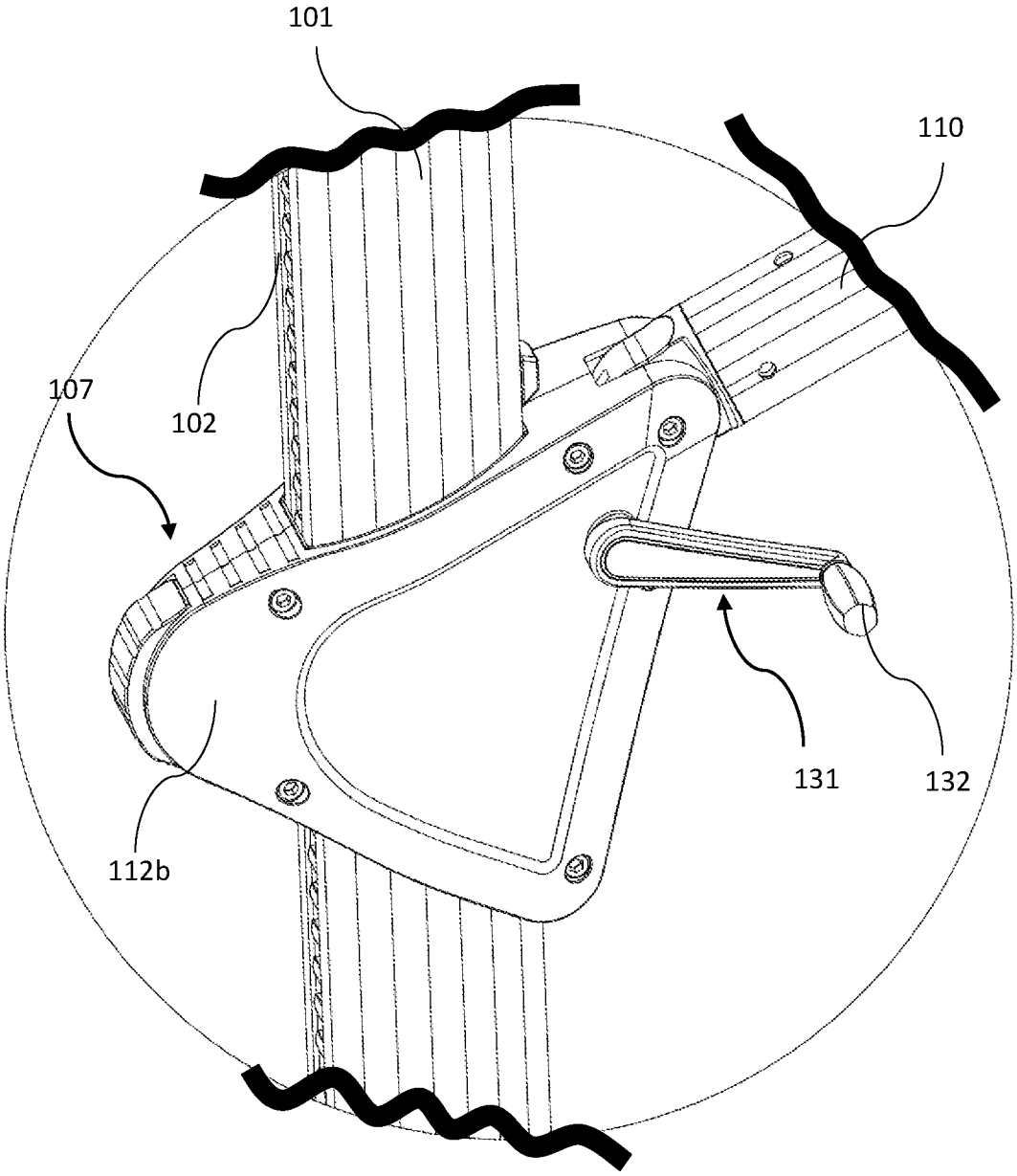
FIG. 4 is a perspective view of the sliding collar from the umbrella from FIG. 1.
Figure 5:
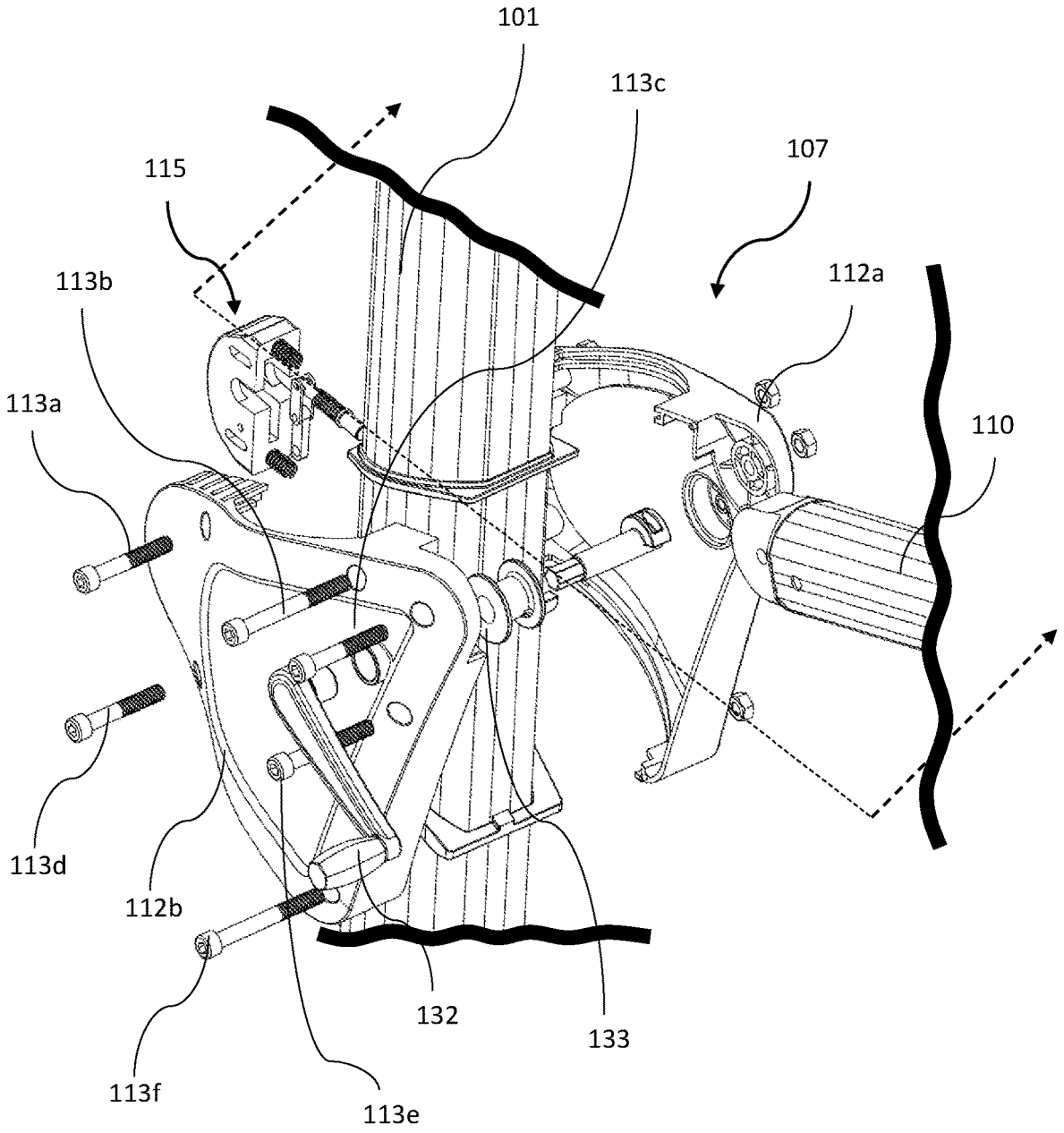
FIG. 5 is an exploded view of the sliding collar from the umbrella from FIG. 1.

As seen in FIGS. 4-5, the umbrella 100 illustratively comprises a winding device 131 carried by the sliding collar 107 and coupled to the canopy 104. The winding device 131 comprises a hand crank 132, and a hub 133 coupled to the hand crank and receiving a cable. The cable is routed through the first arm 110 and to the canopy 104. The winding device 131 is configured to switch the canopy 104 between the open state and the closed state using the hand crank 132.

Another aspect is directed to a method for making an umbrella 100. The method comprises forming a vertical support 101 having a track 102 carried on an outer surface of the vertical support. The track 102 extends longitudinally. The method also includes coupling a sliding collar 107 to the vertical support b101 and configured to slidingly engage the vertical support to control an angle of a canopy 104 with respect to the vertical support. The canopy 104 is configured to switch between an open state and a closed state. The method also comprises coupling a first arm 110 between the sliding collar 107 and the canopy 104, and coupling a second arm 111 between the vertical support 101 and the first arm. The sliding collar 107 comprises first and second housing segments 112*a*-112*b* defining a recess 114, an activation button 115 slidingly received by the recess of the housing and switching between an extended state and a retracted state, and a locking device 116 carried by the first and second housing segments 112*a*-112*b*, the locking device configured to pivot about the first and second housing segments to selectively engage the track 102 in the extended state.

Other features relating to umbrellas are disclosed in U.S. Pat. Nos. 7,604,015; 8,104,492; 9,470,413; 7,882,846; 9,504,298; 7,533,679; 9,622,569; 5,937,882; 6,889,953; and 9,655,417; and pending U.S. patent application Ser. No. 18/186,375, all incorporated herein by reference in their entirety.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. An umbrella comprising:

a vertical support having a track carried on an outer surface of the vertical support, the track extending longitudinally;

a canopy configured to switch between an open state and a closed state;

a sliding collar coupled to the vertical support and configured to slidingly engage the vertical support to control an angle of the canopy with respect to the vertical support;

a first arm coupled between the sliding collar and the canopy; and a second arm coupled between the vertical support and the first arm;

the sliding collar comprising a housing defining a recess, an activation button received by the recess of the housing and switching between an extended state and a retracted state, and a locking device carried by the housing, the locking device comprising a locking arm received in the activation button and pivotably coupled to the housing and having a first end coupled to the activation button, and a second end opposite to the first end, and a locking pin coupled to the second end of the locking arm and configured to selectively engage the track in the extended state.

2. The umbrella of claim 1 wherein the recess comprises a peripheral ledge; and wherein the locking device comprises first and second elastic members coupled between the peripheral ledge and the activation button and configured to bias the activation button in the extended state.

3. The umbrella of claim 1 wherein the activation button defines a longitudinal recess therein to receive the locking arm.

4. The umbrella of claim 1 wherein the locking device comprises a pivot arm coupled between the housing and the locking arm.

5. The umbrella of claim 4 wherein the activation button defines a medial recess therein to receive the pivot arm.

6. The umbrella of claim 1 wherein the locking device comprises an elastic member carried by the locking pin and configured to bias the locking pin to engage the track.

7. The umbrella of claim 1 further comprising a winding device carried by the sliding collar and coupled to the canopy; and wherein the winding device is configured to switch the canopy between the open state and the closed state.

8. An umbrella comprising:

a vertical support having a track carried on an outer surface of the vertical support, the track extending longitudinally;

a canopy configured to switch between an open state and a closed state;

a sliding collar coupled to the vertical support and configured to slidingly engage the vertical support to control an angle of the canopy with respect to the vertical support;

a winding device carried by the sliding collar and coupled to the canopy, the winding device configured to switch the canopy between the open state and the closed state;

a first arm coupled between the sliding collar and the canopy; and a second arm coupled between the vertical support and the first arm;

the sliding collar comprising a housing defining a recess having a peripheral ledge, an activation button received by the recess of the housing and switching between an extended state and a retracted state, and a locking device carried by the housing, the locking device comprising first and second elastic members coupled between the peripheral ledge and the activation button and configured to bias the activation button in the extended state, a locking arm received in the activation button and pivotably coupled to the housing and having a first end coupled to the activation button, and a second end opposite to the first end, and a locking pin coupled to the second end of the locking arm and configured to selectively engage the track in the extended state.

9. The umbrella of claim 8 wherein the activation button defines a longitudinal recess therein to receive the locking arm.

10. The umbrella of claim 8 wherein the locking device comprises a pivot arm coupled between the housing and the locking arm.

11. The umbrella of claim 10 wherein the activation button defines a medial recess therein to receive the pivot arm.

12. The umbrella of claim 8 wherein the locking device comprises a locking pin coupled to the second end of the locking arm and configured to engage the track.

13. The umbrella of claim 12 wherein the locking device comprises a third elastic member carried by the locking pin and configured to bias the locking pin to engage the track.

14. A method for making an umbrella, the method comprising:

forming a vertical support having a track carried on an outer surface of the vertical support, the track extending longitudinally;

coupling a sliding collar to the vertical support and configured to slidingly engage the vertical support to control an angle of a canopy with respect to the vertical support, the canopy configured to switch between an open state and a closed state;

coupling a first arm between the sliding collar and the canopy; and coupling a second arm between the vertical support and the first arm;

the sliding collar comprising a housing defining a recess, an activation button received by the recess of the housing and switching between an extended state and a retracted state, and a locking device carried by the housing, the locking device comprising a locking arm received in the activation button and pivotably coupled to the housing and having a first end coupled to the activation button, and a second end opposite to the first end, and a locking pin coupled to the second end of the locking arm and configured to selectively engage the track in the extended state.

15. The method of claim 14 wherein the recess comprises a peripheral ledge; and wherein the locking device comprises first and second elastic members coupled between the peripheral ledge and the activation button and configured to bias the activation button in the extended state.

16. The method of claim 14 wherein the activation button defines a longitudinal recess therein to receive the locking arm.

17. The method of claim 14 wherein the locking device comprises a pivot arm coupled between the housing and the locking arm.

18. The method of claim 17 wherein the activation button defines a medial recess therein to receive the pivot arm.

19. The method of claim 14 wherein the locking device comprises an elastic member carried by the locking pin and configured to bias the locking pin to engage the track.

20. The method of claim 14 further comprising coupling a winding device to be carried by the sliding collar and to be coupled to the canopy; and wherein the winding device is configured to switch the canopy between the open state and the closed state.

* * * * *